United States Patent [19]

Tsuboi

[11] Patent Number: 5,044,906

[45] Date of Patent: Sep. 3, 1991

[54] SCREW ROTOR FOR SCREW PUMP DEVICE HAVING NEGATIVE TORQUE ON THE FEMALE ROTOR

[75] Inventor: Noboru Tsuboi, Kakogawa, Japan

[73] Assignee: Kabushiki Kaisha Kobe Seiko Sho, Kobe, Japan

[21] Appl. No.: 461,912

[22] Filed: Jan. 8, 1990

[30] Foreign Application Priority Data

Mar. 24, 1989 [JP] Japan ..... 1-73133

[51] Int. Cl.[5] ..... F04C 18/16

[52] U.S. Cl. ..... 418/150; 418/201.3

[58] Field of Search ..... 418/150, 201.3

[56] References Cited

U.S. PATENT DOCUMENTS 3,423,017 1/1969 Shibbye ..... 418/201.3
4,412,796 11/1983 Bowman ..... 418/201.3
4,460,322 7/1984 Shibbye et al. ..... 418/201.3

FOREIGN PATENT DOCUMENTS 58-113595 7/1983 Japan .

*Primary Examiner*—John J. Vrablik
*Attorney, Agent, or Firm*—Oblon, Spivak, McClelland, Maier & Neustadt

[57] ABSTRACT

A screw rotor for a screw pump device includes a male rotor and a female rotor meashing with the male rotor and adapted to be driven by the male rotor, wherein a tooth profile of the female and male rotors is unsymmetrical such that the sum of absorbing torques of the female rotor is negative. Accordingly, a negative torque is always positively applied to the female rotor, thereby preventing the generation of abnormal noise and abnormal vibration due to collision of the tooth surfaces of both the rotors. As a result, a volumetric efficiency and an adiabatic efficiency can be improved.

1 Claim, 5 Drawing Sheets

SCREW ROTOR FOR SCREW PUMP DEVICE HAVING NEGATIVE TORQUE ON THE FEMALE ROTOR

BACKGROUND OF THE INVENTION

The present invention relates to a screw rotor for a screw pump device such as a screw compressor and a screw vacuum pump.

FIGS. 5 to 11 show a known screw compressor including a casing 13 having a suction opening 11 at one end and a discharge opening 12 at the other end, and a pair of female and male screw rotors 14 and 15 (which will be hereinafter referred simply to as rotors) rotatably mounted in the casing 13 and meshing with each other. The male rotor 15 is driven, and the female rotor 14 meshing with the male rotor 15 is rotated by the male rotor 15 in a direction as depicted by an arrow. Gas sucked from the suction opening 11 is enclosed among tooth spaces A of the female and male rotors 14 and 15 and the casing 13. While being compressed during rotation of the rotors 14 and 15, the gas is discharged from a discharge port 16 (see FIGS. 6 to 11) to the discharge opening 12.

FIGS. 6 to 11 show a time dependent change in the tooth spaces A of both the rotors 14 and 15 as viewed from an end surface on the side of the discharge opening 12. FIG. 6 shows a reference condition where a rotational angle $\alpha$ of the male rotor 15 is 0°, and FIGS. 7 to 11 show the conditions where the rotational angles $\alpha$ are 12°, 24°, 36°, 43.2° and 60°, respectively.

In the conditions shown in FIGS. 6 to 10, the tooth space A has a portion opening into the discharge port 16, and is gradually reduced in volume to discharge the compressed gas contained therein to the discharge port 16. On the other hand, in the condition shown in FIG. 11, the tooth space A is completely isolated from the discharge port 16 to define an enclosed space. Under such an enclosed condition, the volume of the enclosed space is reduced toward zero, causing a very high gas pressure in the enclosed space. As a result, both the rotors chatter during rotation to cause the generation of abnormal noise and abnormal vibration.

Such a problem is caused by the fact that the rotor tooth has an unsymmetrical tooth profile. While there have been proposed various unsymmetrical tooth profiles in Japanese Patent Publication Nos. 60-35557 and 60-42359 and Japanese Patent Laid-open Publication No. 60-153486, the above-mentioned problem occurs in any of the proposed unsymmetrical tooth profiles.

The cause of this problem will now be described in more detail. In the conditions shown in FIGS. 6 to 10, the rotor teeth meshing with each other receive a force from the compressed gas in such a direction counter to the rotational direction of the female rotor 14. Accordingly, a torque of the male rotor 15 is transmitted to the female rotor 14 in such a manner that a trailing tooth surface of the female rotor 14 is urged by a leading tooth surface of the male rotor 15. In contrast, in the condition shown in FIG. 11, since the gas pressure in the enclosed tooth space A is abnormally high, the rotor tooth of the female rotor 14 receives a torque (negative torque) which functions to rotate the female rotor 14 in its rotational direction contrary to the case of FIGS. 6 to 10. Accordingly, the female rotor 14 is rotated in such a manner that a leading tooth surface of the female rotor 14 contacts a trailing tooth surface of the male rotor 15. Upon transition from the condition of FIG. 10 to the condition of FIG. 11, the tooth surfaces of both the rotors strike against each other to cause the generation of abnormal noise.

Particularly in case of an oil-cooling type device, a liquid oil is enclosed in the tooth space A under the condition shown in FIG. 11. Therefore, the above problem is remarkable, and there is a possibility that the rotors will be broken occasionally.

In order to prevent this defect, there has been proposed a device for eliminating the abnormal high pressure in the enclosed space, wherein a recess is formed on the end surface of the casing 13 on the discharge opening side facing the rotor accommodating chamber, so as to be communicated with the space on the suction opening side, so that the gas and/or oil contained in the enclosed space may be relieved through the recess to the space on the suction opening side (see Japanese Patent Publication No. 62-358).

Further, there has been proposed a tooth profile intended to prevent the generation of the negative torque (see Japanese Patent Laid-open Publication No. 58-113595).

However, in the device disclosed in Japanese Patent Publication No. 62-358, since the high-pressure gas in the enclosed space is relieved to the space on the suction opening side so as to prevent the generation of the negative torque, volumetric efficiency and adiabatic efficiency are deteriorated.

In the device disclosed in Japanese Patent Laid-open Publication No. 58-113595, there is a possibility of the negative torque being generated because of any factors such as a shape of the discharge port and a rotating speed of the rotors. Thus, there remain indefinite factors as to the generation of the negative torque in this prior art device.

In any case, these prior art devices are so designed as to aim to reduce or eliminate the negative torque.

SUMMARY OF THE INVENTION

It is an object of the present invention to provide a screw rotor for a screw pump device which may prevent the generation of abnormal noise and abnormal vibration to thereby improve the volumetric efficiency and the adiabatic efficiency by positively applying the negative torque to the female rotor at all times.

According to the present invention, there is provided a screw rotor for a screw pump device comprising a male rotor and a female rotor meshing with said male rotor and adapted to be driven by said male rotor, wherein a tooth profile of said female and male rotors is unsymmetrical such that the sum of absorbing torques of said female rotor is negative.

With this construction, the negative torque is always applied to the female rotor, and the female rotor is rotated to follow the male rotor under the condition where the leading tooth surface of the female rotor is always in contact with the trailing tooth surface of the male rotor. Accordingly, the collision between both the tooth surfaces can be prevented.

Other objects and features of the invention will be more fully understood from the following detailed description and appended claims when taken with the accompanying drawings.

DETAILED DESCRIPTION OF THE PREFERRED EMBODIMENT

There will now be described a preferred embodiment of the present invention with reference to the drawings.

Figure 1:
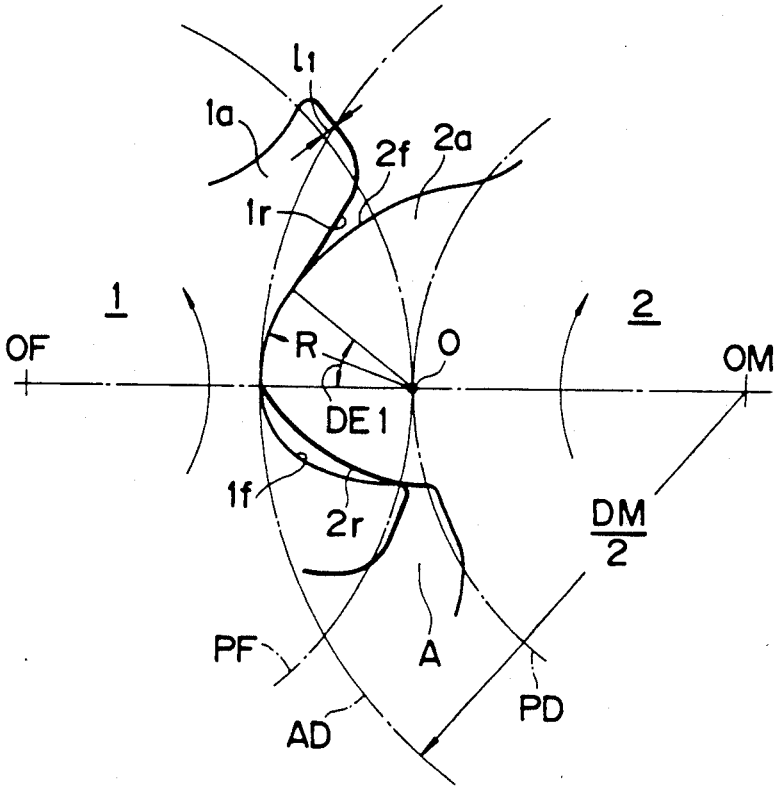
FIG. 1 is an enlarged elevational view of a meshing portion of the rotors according to the present invention.
Figure 6:
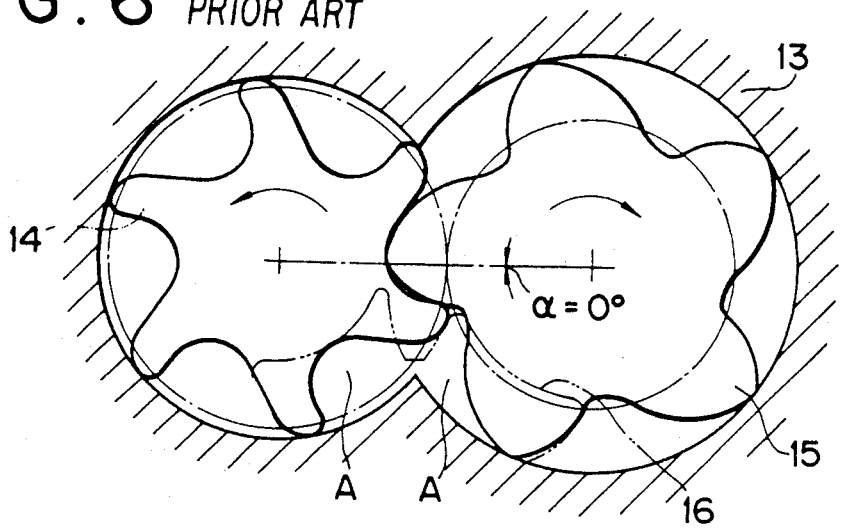
FIG. 6 PRIOR ART
FIGS. 6 to 11 are end views of the rotors mounted in the screw compressor as viewed from the discharge opening side, showing a timing change of the rotative condition of the rotors.
Figure 7:
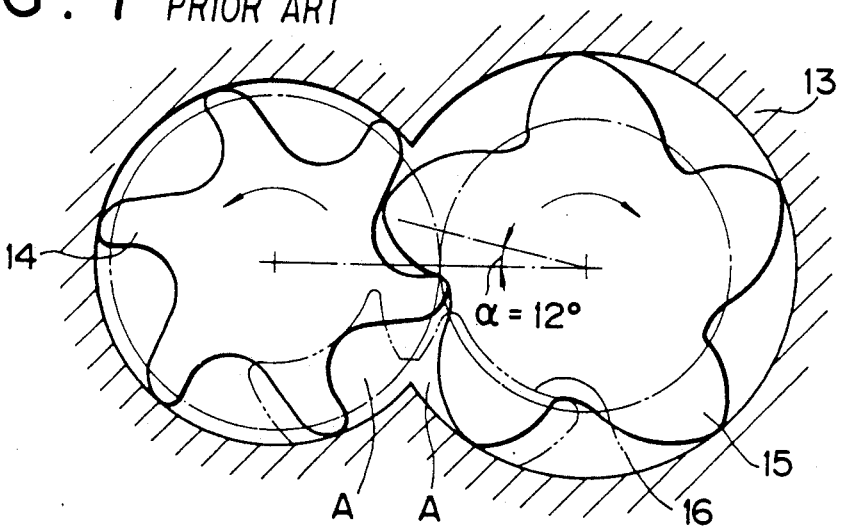
FIG. 7 PRIOR ART
Figure 8:
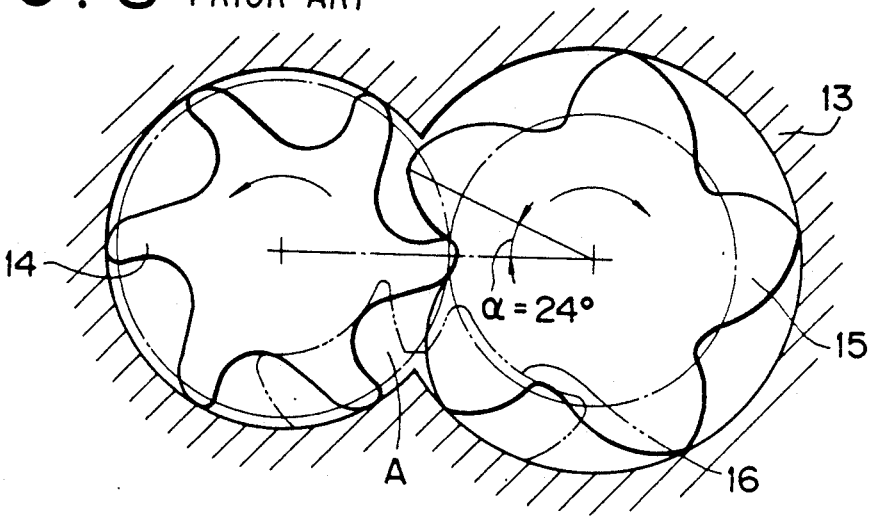
FIG. 8 PRIOR ART
Figure 9:
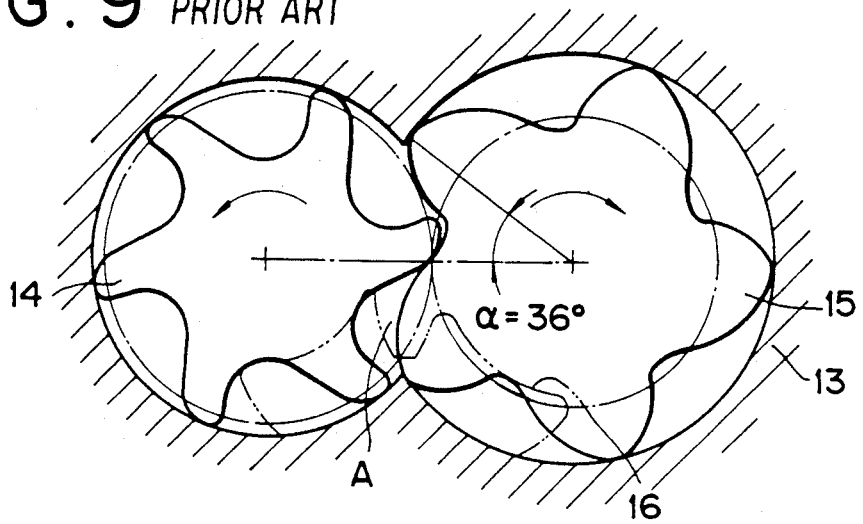
FIG. 9 PRIOR ART
Figure 10:
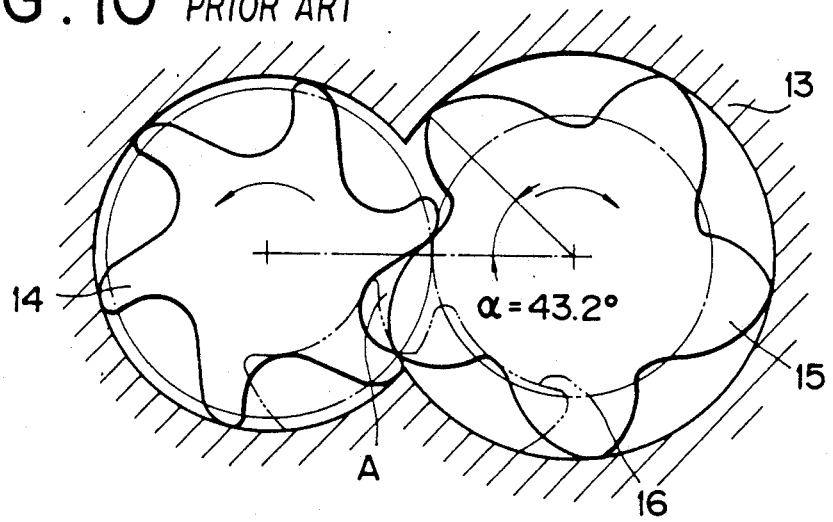
FIG. 10 PRIOR ART
Figure 11:
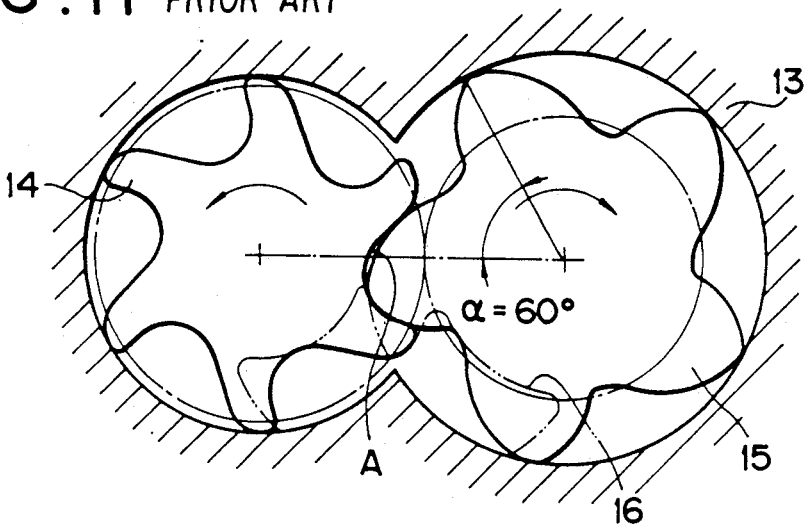
FIG. 11 PRIOR ART

Referring to FIG. 1, a pair of female and male rotors 1 and 2 mesh with each other, and the condition shown in FIG. 1 corresponds to the condition shown in FIG. 6 where the rotational angle $\alpha$ is 0° and the tooth space A is defined below the meshing teeth. As will be described hereinafter, a negative torque is always applied to the female rotor 1, and the female rotor 1 is rotated to follow male rotor 2 under the condition where a leading tooth surface 1*f* of a rotor tooth 1*a* of the female rotor 1 is in contact with a trailing tooth surface 2*r* of a rotor tooth 2*a* of the male rotor 2.

In FIG. 1, OF and OM denote centers of the female rotor 1 and the male rotor 2, respectively; PF and PD denote pitch circles of the female rotor 1 and the male rotor 2, respectively; AD denotes an addendum circle of the male rotor 2; DM denotes a diameter of the addendum circle AD of the male rotor 2; l1 denotes an addendum of the female rotor 1; and DE1 denotes an opening angle of a sectionally arcuate portion having a radius R and a center O as formed by the contact of a leading tooth surface 2*f* of the rotor tooth 2*a* of the male rotor 2 with a trailing tooth surface 1*r* of the rotor tooth 1*a* of the female rotor 1 under the condition of the rotational angle $\alpha=0°$.

Figure 5:
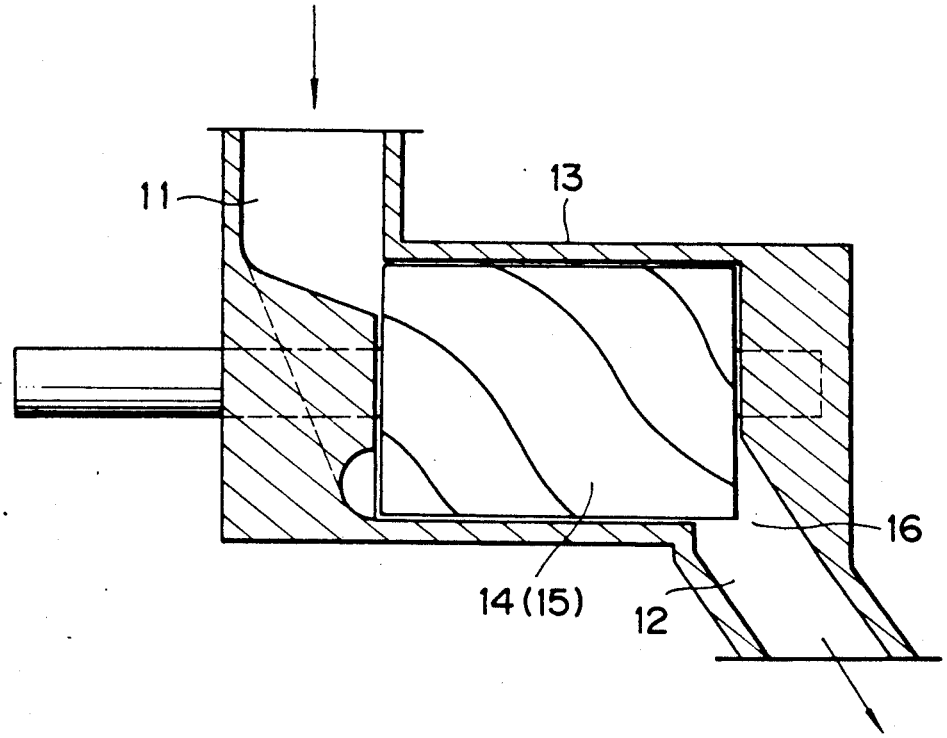
FIG. 5 PRIOR ART
FIG. 5 is a vertical sectional view of A known screw compressor.

The relationship between the rotational angle $\alpha$ and a torque of the female rotor 1 to be absorbed from the male rotor 2 during rotation of both the rotors will now be discussed in case of adapting the rotors in this preferred embodiment to the device shown in FIG. 5.

Basically, a time dependent change of the condition of the rotors at the end surface on the discharge opening side corresponds to that shown in FIGS. 6 to 11 in accordance with the respective rotational angle $\alpha$, and the torque to be applied to the female rotor 1 is generated by the tooth space A to be defined in the stage between that where it opens into the discharge port 16 and that where it communicates with the suction opening 11. The other tooth spaces do not contribute to the generation of the torque since the pressure in each tooth space is balanced.

Figure 2:
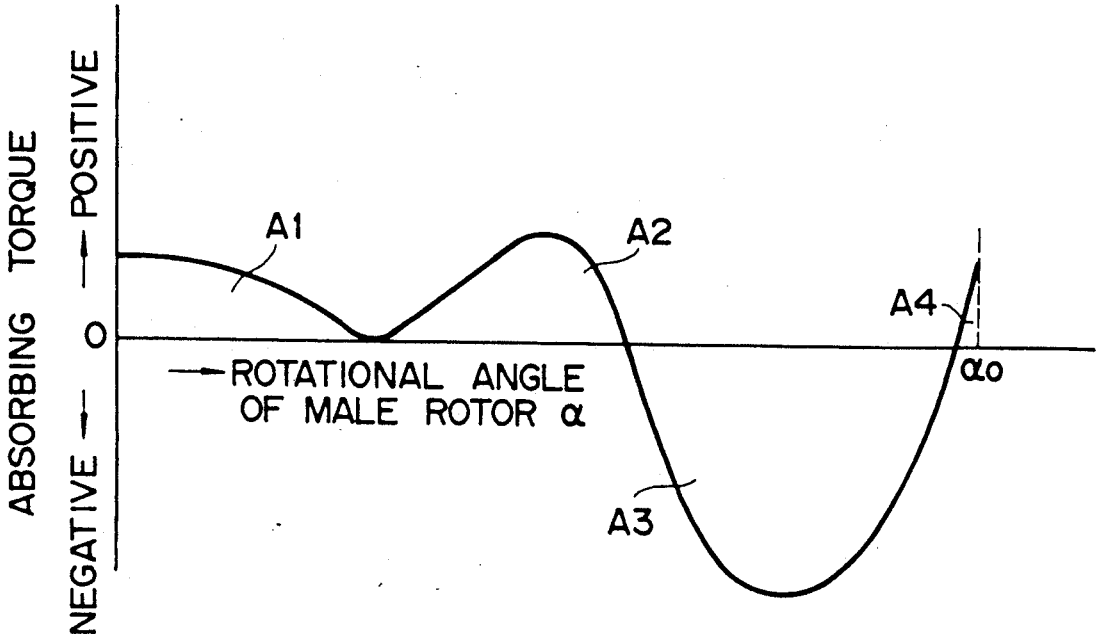
FIG. 2 is a graph showing the relationship between a rotational angle of the male rotor and an absorbing torque of the female rotor.

The relationship between the rotational angle $\alpha$ and the torque to be absorbed by the female rotor 1 is shown in FIG. 2. The torque curve shown in FIG. 2 is repeated per a given angle $\alpha_0$ during rotation of the female rotor 1. In this preferred embodiment, the given angle $\alpha_0$ is 72° (=360°/5) since the number of teeth of the male rotor 2 is five. In another case where the number of teeth is four, for example, the given angle $\alpha_0$ would be 90°. Further, a positive absorbing torque of the female rotor 1 means that the female rotor 1 receives from the compressed gas a force which functions to rotate the female rotor 1 in a direction counter to the rotational direction thereof.

While the time dependent change of the condition of the rotor as shown in FIGS. 6 to 11 occurs at the end surface of the rotor on the discharge opening side, the conditions shown in FIGS. 6 to 11 also govern each condition of cross sections perpendicular to a rotor shaft at given axial positions in the axial direction of the rotor shaft at an appropriate moment. For example, when the rotors are in the condition shown in FIG. 11 as viewed from the end surface on the discharge opening side, the conditions of the cross sections at the given axial positions toward the suction opening are varied from FIG. 11 to FIG. 6. That is, the change in the conditions of the cross sections is reverse to the time dependent change. Even thus considering the relationship between the rotor axial position and the rotor rotational angle, it can be said that the condition of each cross section is repeated with a given phase difference from FIG. 6 to FIG. 11 and that the torque curve shown in FIG. 2 defines an absorbing torque of the female rotor 1 with respect to an axial position of the cross sections of the female rotor 1.

Accordingly, the sum of the torques to be absorbed by the overall length of the female rotor 1 at an appropriate moment can be represented by an integral of the torque curve shown in FIG. 2. That is, the sum of the absorbing torques can be represented by an area ($A_1+A_2-A_3+A_4$). According to the present invention, this area is set to be negative at all times, so that the negative torque may be always applied to the female rotor 1.

Figure 3:
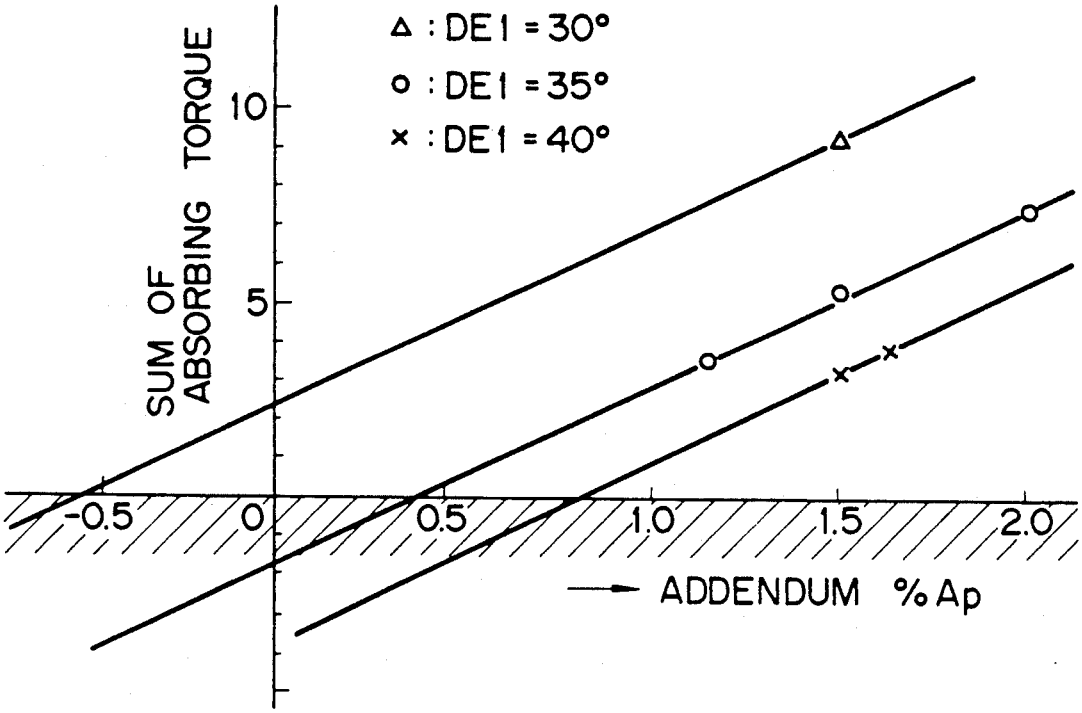
FIG. 3 is a graph showing the relationship between an addendum % of the female rotor and a sum of the absorbing torques of the female rotor.

The sum of the absorbing torques is dependent upon a tooth profile of the rotor. FIG. 3 shows the relationship between the sum of the absorbing torques and an addendum % Ap represented by $(l1/DM)\times 100$ with the opening angle De1 being used as a parameter. According to the present invention, the sum of the absorbing torques belongs to a negative region as hatched. As apparent from FIG. 3, there is a case where the addendum % becomes negative.

Figure 4:
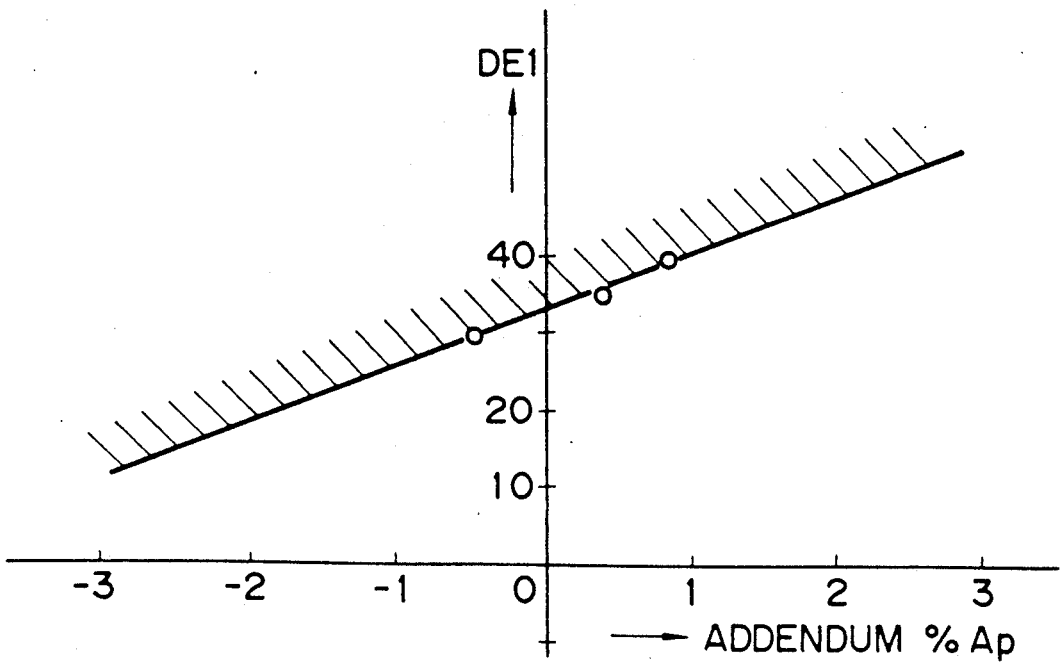
FIG. 4 is a graph showing the relationship between the addendum % of the female rotor and an opening angle DE1.

Accordingly, a boundary of the addendum % to be included in the present invention should be determined for each value of De1. FIG. 4 shows the relationship between the boundary of the addendum % and the value of DE1. As apparent from FIG. 4, a hatched region is included in the present invention wherein the sum of the absorbing torques becomes negative, and the relationship can be expressed as follows:

$$DE1 \geqq 7.7\ Ap+33$$

Although the present invention is particularly suitable for an oil-cooling type screw pump device, it is not limited to this type but may be applied to an oil-free type.

What is claimed is:

1. A screw rotor for a screw pump device comprising a male rotor and a female rotor meshing with said male rotor and adapted to be driven by said male rotor, wherein tooth profiles of said female and male rotors are unsymmetrical such that the sum of absorbing torques of said female rotor is negative, wherein $$DE1 \geqq 7.7\ Ap+33$$

wherein,

DE1 is an opening angle of a sectionally arcuate portion of said male rotor, and Ap is an addendum % defined as $(l1/DM)\times 100$, wherein l1 is an addendum of the female rotor and DM is the diameter of the addendum circle of the male rotor.

* * * * *